US009881553B2

(12) United States Patent
Chen et al.

(10) Patent No.: US 9,881,553 B2
(45) Date of Patent: Jan. 30, 2018

(54) OLED DRIVE SYSTEM RAISING FRAME CONTRAST AND DRIVE METHOD

(71) Applicant: Shenzhen China Star Optoelectronics Technology Co., Ltd., Shenzhen (CN)

(72) Inventors: Xiaolong Chen, Shenzhen (CN); Chihhao Wu, Shenzhen (CN); Mingfeng Chen, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 183 days.

(21) Appl. No.: 14/787,771

(22) PCT Filed: Oct. 12, 2015

(86) PCT No.: PCT/CN2015/091718

§ 371 (c)(1),
(2) Date: Oct. 29, 2015

(87) PCT Pub. No.: WO2017/041344

PCT Pub. Date: Mar. 16, 2017

(65) Prior Publication Data

US 2017/0163266 A1 Jun. 8, 2017

(51) Int. Cl.
*G09G 3/3258* (2016.01)

(52) U.S. Cl.
CPC ... *G09G 3/3258* (2013.01); *G09G 2300/0871* (2013.01); *G09G 2310/08* (2013.01); *G09G 2320/0233* (2013.01); *G09G 2320/066* (2013.01)

(58) Field of Classification Search
CPC ..... G09G 3/3258; G09G 2320/066; G09G 2300/0871; G09G 2310/08; G09G 2320/0233
See application file for complete search history.

(56) References Cited

U.S. PATENT DOCUMENTS

| | | | | |
|---|---|---|---|---|
| 2005/0001801 | A1* | 1/2005 | Kim | G09G 3/3406 345/89 |
| 2014/0152721 | A1* | 6/2014 | Byun | G09G 3/3208 345/691 |
| 2016/0049113 | A1* | 2/2016 | Park | G09G 3/3225 345/212 |
| 2016/0062028 | A1* | 3/2016 | Aoki | G02B 6/0061 362/606 |

* cited by examiner

*Primary Examiner* — Premal R Patel
(74) *Attorney, Agent, or Firm* — Leong C. Lei

(57) ABSTRACT

An OLED drive system raising a frame contrast and a drive method are disclosed. The OLED display panel is equally divided into a plurality of display divisions along a vertical direction. The brightness calculation module is employed to calculate average pixel brightnesses corresponding to the respective display divisions in the OLED display panel. On one hand, the power management module is employed to supply different reference voltages for the respective display divisions correspondingly according to the average pixel brightnesses of the respective display divisions in the OLED display panel, and respectively insert the reference voltages of the respective display divisions into reference voltage lines corresponding to the pixels of middle rows in the display divisions to make the reference voltages of the respective display divisions be different for raising the frame contrast.

4 Claims, 7 Drawing Sheets

OLED DRIVE SYSTEM RAISING FRAME CONTRAST AND DRIVE METHOD

FIELD OF THE INVENTION

The present invention relates to a display technology field, and more particularly to an OLED drive system raising a frame contrast and a drive method.

BACKGROUND OF THE INVENTION

The Organic Light Emitting Display (OLED) possesses many outstanding properties of self-illumination, low driving voltage, high luminescence efficiency, short response time, high clarity and contrast, near 180° view angle, wide range of working temperature, applicability of flexible display and large scale full color display. The OLED is considered as the most potential display device.

The OLED display device comprises a plurality of pixels aligned in array. The pixel drive circuit is utilized to drive the organic light emitting diode to emit light. FIG. 1 shows a 3T1C pixel drive circuit of an OLED, comprising: a first thin film transistor T1, a second thin film transistor T2, a third thin film transistor T3, a storage capacitor Cst and an organic light emitting diode D. In comparison with traditional 2T1C pixel drive circuit, the third thin film transistor T3 is added in the 3T1C pixel drive circuit. The second thin film transistor T2 is a drive thin film transistor, and a gate and a source of the second thin film transistor T2 are respectively coupled to a first node A and a second node S; the first thin film transistor T1 is employed to charge the first node A, i.e. the gate of the second thin film transistor T2; a gate of the third thin film transistor T3 receives a discharge control signal DCS, and a source is electrically coupled to the first node A, and a drain receives a reference voltage line Vref, and the third thin film transistor T3 is employed to discharge the first node A, i.e. the gate of the second thin film transistor T2. After the gate of the third thin film transistor T3 is on to charge the node A, and the voltage is stable, the node A voltage is about the reference voltage Vref, which acts to discharge the organic light emitting diode D. That is to say, the voltage value of the node A after discharge can be controlled by controlling the value of the reference voltage Vref.

The formula of calculating the current I flowing through the organic light emitting diode is:

$$I=k(V_{GS}-V_{th})^2=k(V_A-V_S-V_{th})^2$$

wherein k is an intrinsic conductive factor of the drive thin film transistor, i.e. the second thin film transistor T2, and $V_{GS}$ is a gate-source voltage of the second thin film transistor T2, and $V_{th}$ is a threshold voltage of the second thin film transistor T2, and $V_A$ is the voltage of the first node A, i.e. a gate voltage of the second thin film transistor T2, and $V_S$ is a voltage of the second node S, i.e. a source voltage of the second thin film transistor T2.

The Pulse-Width Modulation (PWM) drive method is to control the duration of charge and discharge of respective sub frames in one frame by controlling the on-periods of the first thin film transistor T1 and the third thin film transistor T3. With combination that the sense of the human eyes to the brightness is the integral principle of time, the digital voltage (i.e. two Gamma voltages) can be utilized for showing pictures of various gray scale brightnesses.

In prior art, the reference voltages Vref of all the OLED pixel drive circuit are generally set to be some constant value. Namely, the reference voltages Vref of the pixel drive circuits of respective rows are equal. Under such circumstance, as shown in FIG. 2, the display brightness (Luminance) of the OLED increases from the first luminance L1 to the second luminance L2 along with the increase of the Gray level of the display frame. The contrast of the display frame can be calculated and obtained from the formula Contrast=L2/L1. Ultimately, the obtained frame contrast is lower.

SUMMARY OF THE INVENTION

An objective of the present invention is to provide an OLED drive system capable of raising a frame contrast and ensuring the frame display quality.

Another objective of the present invention is to provide an OLED drive method capable of raising a frame contrast and ensuring the frame display quality.

For realizing the aforesaid objective, the present invention provides an OLED drive system raising a frame contrast, comprising: an image input module, a brightness calculation module, a power management module and an OLED display panel, which are electrically coupled in sequence;

the OLED display panel comprises a plurality of pixels aligned in array, and a pixel drive circuit is provided in each pixel; the pixel drive circuit comprises a first thin film transistor, a second thin film transistor, a third thin film transistor, a storage capacitor and an organic light emitting diode, and the second thin film transistor is employed to drive the organic light emitting diode, and the first thin film transistor is employed to charge a gate of the second thin film transistor, and the third thin film transistor is employed to discharge the gate of the second thin film transistor; a gate of the third thin film transistor receives a discharge control signal, and a source is electrically coupled to the gate of the second thin film transistor, and a drain is electrically coupled to a reference voltage line corresponded with a row where the pixel is; the OLED display panel is equally divided into a plurality of display divisions along a vertical direction, and each display division comprises pixels of equal row numbers;

the image input module is employed to provide image data of one frame to the brightness calculation module;

the brightness calculation module is employed to calculate average pixel brightnesses corresponding to the respective display divisions in the OLED display panel, and transmits the average pixel brightnesses of the respective display divisions to the power management module;

the power management module is employed to supply different reference voltages for the respective display divisions correspondingly according to the average pixel brightnesses of the respective display divisions in the OLED display panel, and respectively insert the reference voltages of the respective display divisions into reference voltage lines corresponding to the pixels of middle rows in the display divisions.

The OLED drive system raising the frame contrast further comprises: an image compensation module electrically coupled to the image input module and the brightness calculation module, a sequence controller electrically coupled to the image compensation module and a source driver electrically coupled to the sequence controller and the OLED display panel;

the image compensation module is employed to receive the image data of one frame provided by the image input module, and the brightness calculation module calculates the average pixel brightnesses corresponding to the respective display divisions in the OLED display panel, and compensates the image data of one frame according to the average pixel brightnesses of the respective display divisions in the OLED display panel, and sends the compensated image data to the sequence controller, the source driver and the OLED display panel.

An amount of the display divisions of dividing the OLED display panel is determined according to a resolution of the OLED display panel.

A gate of the first thin film transistor is electrically coupled to a scan line corresponded with a row where the pixel is, and a source is electrically coupled to a data line corresponded with a column where the pixel is, and a drain is electrically coupled to a first node; a gate of the second thin film transistor is electrically coupled to the first node, and a drain is electrically coupled to a second node, and a drain receives a power supply positive voltage; one end of the storage capacitor is electrically coupled to the first node, and the other end is electrically coupled to the drain of the second thin film transistor; an anode of the organic light emitting diode is electrically coupled to the second node, and a cathode receives a power source negative voltage. The present invention further provides an OLED drive method of raising a frame contrast, comprising steps of:

step 1, providing an OLED drive system;

the OLED drive system comprises: an image input module, a brightness calculation module, a power management module and an OLED display panel, which are electrically coupled in sequence;

the OLED display panel comprises a plurality of pixels aligned in array, and a pixel drive circuit is provided in each pixel; the pixel drive circuit comprises a first thin film transistor, a second thin film transistor, a third thin film transistor, a storage capacitor and an organic light emitting diode, and the second thin film transistor is employed to drive the organic light emitting diode, and the first thin film transistor is employed to charge a gate of the second thin film transistor, and the third thin film transistor is employed to discharge the gate of the second thin film transistor; a gate of the third thin film transistor receives a discharge control signal, and a source is electrically coupled to the gate of the second thin film transistor, and a drain is electrically coupled to a reference voltage line corresponded with a row where the pixel is; the OLED display panel is equally divided into a plurality of display divisions along a vertical direction, and each display division comprises pixels of equal row numbers;

step 2, the image input module provides image data of one frame to the brightness calculation module, and the brightness calculation module calculates average pixel brightnesses corresponding to the respective display divisions in the OLED display panel, and transmits the average pixel brightnesses of the respective display divisions to the power management module; the power management module supplies different reference voltages for the respective display divisions correspondingly according to the average pixel brightnesses of the respective display divisions in the OLED display panel, and respectively inserts the reference voltages of the respective display divisions into reference voltage lines corresponding to the pixels of middle rows in the display divisions.

The OLED drive system provided in the step 1 further comprises: an image compensation module electrically coupled to the image input module and the brightness calculation module, a sequence controller electrically coupled to the image compensation module and a source driver electrically coupled to the sequence controller and the OLED display panel;

the OLED drive method of raising the frame contrast further comprises a step 3, the image compensation module receives the image data of one frame provided by the image input module, and the brightness calculation module calculates the average pixel brightnesses corresponding to the respective display divisions in the OLED display panel, and compensates the image data of one frame according to the average pixel brightnesses of the respective display divisions in the OLED display panel, and sends the compensated image data to the sequence controller, the source driver and the OLED display panel.

In the step 2, the average brightness of some display division in the OLED display panel calculated by the brightness calculation module is larger, and the reference voltage that the power management module correspondingly provides to the display division is higher.

A gate of the first thin film transistor is electrically coupled to a scan line corresponded with a row where the pixel is, and a source is electrically coupled to a data line corresponded with a column where the pixel is, and a drain is electrically coupled to a first node; a gate of the second thin film transistor is electrically coupled to the first node, and a drain is electrically coupled to a second node, and a drain receives a power supply positive voltage; one end of the storage capacitor is electrically coupled to the first node, and the other end is electrically coupled to the drain of the second thin film transistor; an anode of the organic light emitting diode is electrically coupled to the second node, and a cathode receives a power source negative voltage.

The present invention further provides an OLED drive system of raising a frame contrast, comprising: an image input module, a brightness calculation module, a power management module and an OLED display panel, which are electrically coupled in sequence;

the OLED display panel comprises a plurality of pixels aligned in array, and a pixel drive circuit is provided in each pixel; the pixel drive circuit comprises a first thin film transistor, a second thin film transistor, a third thin film transistor, a storage capacitor and an organic light emitting diode, and the second thin film transistor is employed to drive the organic light emitting diode, and the first thin film transistor is employed to charge a gate of the second thin film transistor, and the third thin film transistor is employed to discharge the gate of the second thin film transistor; a gate of the third thin film transistor receives a discharge control signal, and a source is electrically coupled to the gate of the second thin film transistor, and a drain is electrically coupled to a reference voltage line corresponded with a row where the pixel is; the OLED display panel is equally divided into a plurality of display divisions along a vertical direction, and each display division comprises pixels of equal row numbers;

the image input module is employed to provide image data of one frame to the brightness calculation module;

the brightness calculation module is employed to calculate average pixel brightnesses corresponding to the respective display divisions in the OLED display panel, and transmits the average pixel brightnesses of the respective display divisions to the power management module;

the power management module is employed to supply different reference voltages for the respective display divisions correspondingly according to the average pixel brightnesses of the respective display divisions in the OLED display panel, and respectively inserting the reference voltages of the respective display divisions into reference voltage lines corresponding to the pixels of middle rows in the display divisions;

the method further comprises: an image compensation module electrically coupled to the image input module and the brightness calculation module, a sequence controller electrically coupled to the image compensation module and a source driver electrically coupled to the sequence controller and the OLED display panel;

the image compensation module is employed to receive the image data of one frame provided by the image input module, and the brightness calculation module calculates the average pixel brightnesses corresponding to the respective display divisions in the OLED display panel, and compensates the image data of one frame according to the average pixel brightnesses of the respective display divisions in the OLED display panel, and sends the compensated image data to the sequence controller, the source driver and the OLED display panel;

wherein an amount of the display divisions of dividing the OLED display panel is determined according to a resolution of the OLED display panel;

wherein a gate of the first thin film transistor is electrically coupled to a scan line corresponded with a row where the pixel is, and a source is electrically coupled to a data line corresponded with a column where the pixel is, and a drain is electrically coupled to a first node; a gate of the second thin film transistor is electrically coupled to the first node, and a drain is electrically coupled to a second node, and a drain receives a power supply positive voltage; one end of the storage capacitor is electrically coupled to the first node, and the other end is electrically coupled to the drain of the second thin film transistor; an anode of the organic light emitting diode is electrically coupled to the second node, and a cathode receives a power source negative voltage.

The benefits of the present invention are: the present invention provides an OLED drive system raising a frame contrast and a drive method. The OLED display panel is equally divided into a plurality of display divisions along a vertical direction. The brightness calculation module is employed to calculate average pixel brightnesses corresponding to the respective display divisions in the OLED display panel. On one hand, the power management module is employed to supply different reference voltages for the respective display divisions correspondingly according to the average pixel brightnesses of the respective display divisions in the OLED display panel, and respectively insert the reference voltages of the respective display divisions into reference voltage lines corresponding to the pixels of middle rows in the display divisions to make the reference voltages of the respective display divisions be different for raising the frame contrast, on the other hand, the image compensation module is employed to compensate the image data of one frame according to the average pixel brightnesses of the respective display divisions in the OLED display panel for ensuring the frame display quality.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 3:
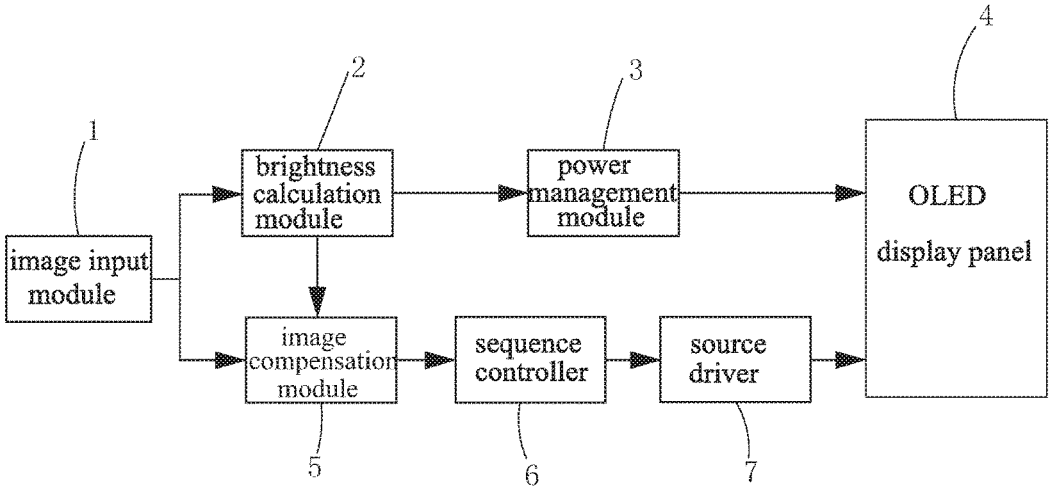
FIG. 3 is a structure diagram of an OLED drive system of raising a frame contrast according to the present invention.
Figure 4:
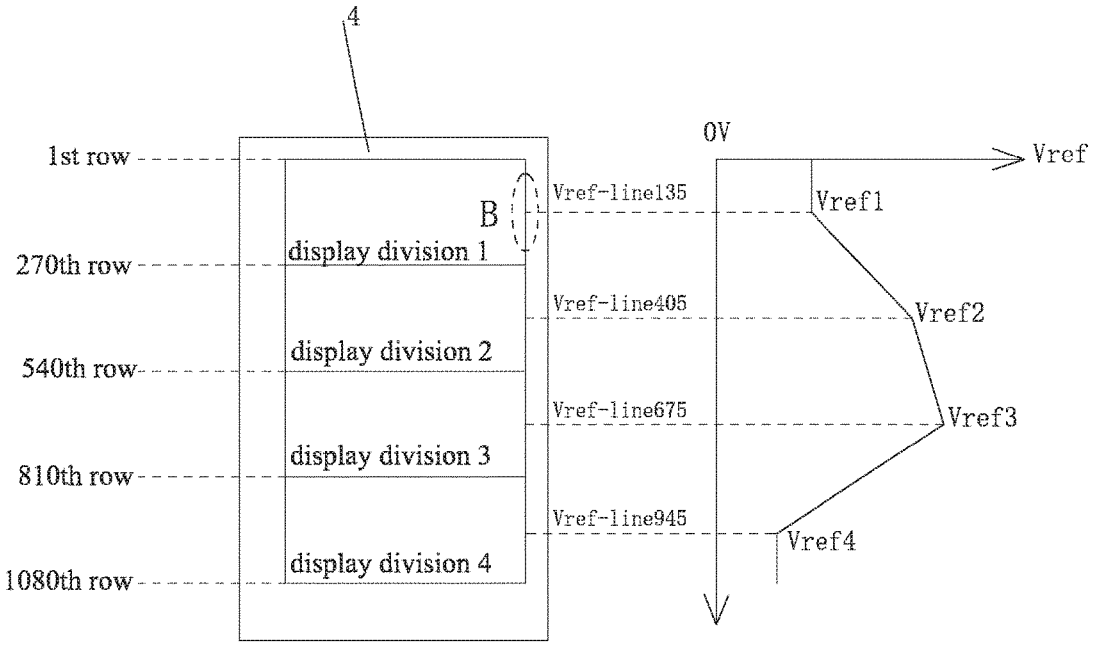
FIG. 4 is one illustration of the OLED display panel divided into display divisions and the reference voltages inserted corresponding to the respective display divisions in the OLED drive system of raising the frame contrast according to the present invention.

Please refer to FIG. 3, FIG. 4 at the same time. The present invention provides an OLED drive system raising a frame contrast, comprising: an image input module 1, a brightness calculation module 2, a power management module 3 and an OLED display panel 4, which are electrically coupled in sequence, an image compensation module 5 electrically coupled to the image input module 1 and the brightness calculation module 2, a sequence controller 6 electrically coupled to the image compensation module 5 and a source driver 7 electrically coupled to the sequence controller 6 and the OLED display panel 4.

Figure 1:
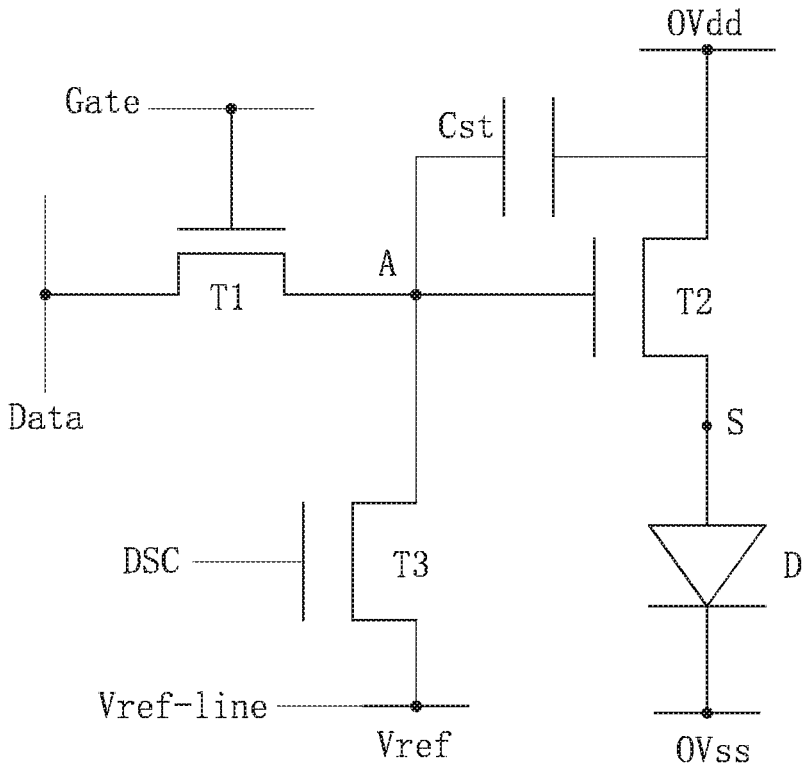
Fig. 1 (Prior Art)
FIG. 1 is a diagram of an OLED 3T1C pixel drive circuit according to prior art.
Figure 2:
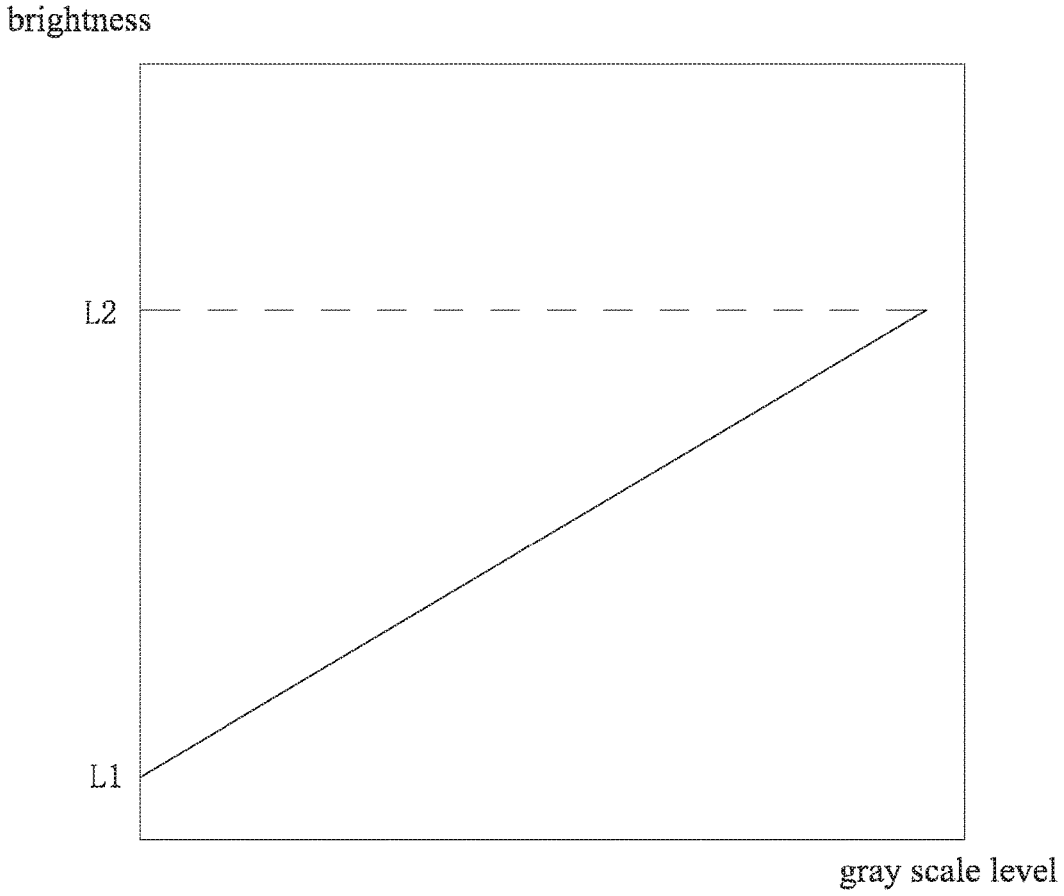
Fig. 2 (Prior Art)
FIG. 2 is a relation curve of gray scale level and brightness of the OLED display frame in prior art.

The OLED display panel 4 comprises a plurality of pixels aligned in array, and a pixel drive circuit is provided in each pixel. As shown in FIG. 1, the pixel drive circuit comprises a first thin film transistor T1, a second thin film transistor T2, a third thin film transistor T3, a storage capacitor Cst and an organic light emitting diode D. A gate of the first thin film transistor T1 is electrically coupled to a scan line Gate corresponded with a row where the pixel is, and a source is electrically coupled to a data line Data corresponded with a column where the pixel is, and a drain is electrically coupled to a first node A; a gate of the second thin film transistor T2 is electrically coupled to the first node A, and a drain is electrically coupled to a second node S, and a drain receives a power supply positive voltage OVdd; a gate of the third thin film transistor T3 receives a discharge control signal DCS, and a source is electrically coupled to the gate of the second thin film transistor T2, and a drain is electrically coupled to a reference voltage line Vref-line corresponded with a row where the pixel is; one end of the storage capacitor Cst is electrically coupled to the first node A, and the other end is electrically coupled to the drain of the second thin film transistor T2; an anode of the organic light emitting diode D is electrically coupled to the second node S, and the cathode receives a power source negative voltage OVss. The second thin film transistor T2 is employed to drive the organic light emitting diode D, and the first thin film transistor T1 is employed to charge a gate of the second thin film transistor T2, and the third thin film transistor T3 is employed to discharge the gate of the second thin film transistor T2. The 3T1C pixel drive circuit employs the PWM drive method to control the duration of charge and discharge of respective sub frames in one frame by controlling the on-periods of the first thin film transistor T1 and the third thin film transistor T3. With combination that the sense of the human eyes to the brightness is the integral principle of time, the digital voltage is utilized for showing pictures of various gray scale brightnesses and changing the reference voltage Vref transmitted in the reference voltage line Vref-line. The relation of the frame gray level and the brightness will also change along with. The contrast of the frame can be adjusted by changing the values of the reference voltage Vref.

Significantly, the OLED display panel 4 is equally divided into a plurality of display divisions along a vertical direction, and each display division comprises pixels of equal row numbers. The amount of the display divisions of dividing the OLED display panel 4 is not particularly restricted but can be determined according to a resolution of the OLED display panel 4. The larger the resolution of the OLED display panel is, the more is the amount of the display divisions of dividing the OLED display panel. The OLED display panel 4 of resolution 1080×720 is illustrated. Namely, the OLED display panel 4 comprises pixels of 1080 rows, 720 columns. As shown in FIG. 4, the OLED display panel 4 is equally divided into 4 display divisions. Each display division comprises pixels of 270 rows: the display division 1 comprises pixels of 1st row to 270th row, and the display division 2 comprises pixels of 271th row to 540th row, and the display division 3 comprises pixels of 541th row to 810th row, and the display division 4 comprises pixels of 811th row to 1080th row.

The image input module 1 is employed to provide image data of one frame to the brightness calculation module 2.

The brightness calculation module 2 is employed to calculate average pixel brightnesses (Average Pixel Luminance, API) corresponding to the respective display divisions in the OLED display panel 4, and transmits the average pixel brightnesses of the respective display divisions to the power management module 3. As shown in FIG. 4, as an illustration, the OLED display panel 4 of resolution 1080×720 is divided into 4 display divisions. The brightness calculation module 2 calculates the average pixel brightnesses corresponding to the 4 display divisions in the OLED display panel 4, and transmits the average pixel brightnesses of the 4 display divisions to the power management module 3.

Figure 5:
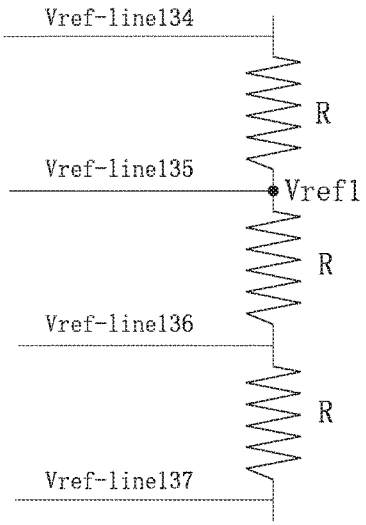
FIG. 5 is a detail diagram corresponding to B position in FIG. 4.

The power management module 3 supplies different reference voltages for the respective display divisions correspondingly according to the average pixel brightnesses of the respective display divisions in the OLED display panel 4, and respectively inserts the reference voltages of the respective display divisions into reference voltage lines Vref-line corresponding to the pixels of middle rows in the display divisions. As shown in FIG. 4, as an illustration, the OLED display panel 4 of resolution 1080×720 is divided into 4 display divisions. The power management module 3 supplies the first reference voltage Vref1 for the display division 1 correspondingly according to the average pixel brightnesses of the 4 display divisions in the OLED display panel 4, and inserts the first reference voltage Vref1 of the display division 1 into the pixels of middle row in the display division 1, i.e. the reference voltage line Vref-line 135 of the pixels of the 135th row; supplies the second reference voltage Vref2 for the display division 2, and inserts the second reference voltage Vref2 of the display division 2 into the pixels of middle row in the display division 2, i.e. the reference voltage line Vref-line 405 of the pixels of the 405th row; supplies the third reference voltage Vref3 for the display division 3, and inserts the third reference voltage Vref3 of the display division 3 into the pixels of middle row in the display division 3, i.e. the reference voltage line Vref-line 675 of the pixels of the 675th row; supplies the fourth reference voltage Vref4 for the display division 4, and inserts the second reference voltage Vref4 of the display division 4 into the pixels of middle row in the display division 4, i.e. the reference voltage line Vref-line 945 of the pixels of the 945th row. Significantly, with combination of FIG. 4 and FIG. 5, due to the manufacture reason of the OLED display panel, an equal equivalent resistance R exists between two adjacent reference voltage lines Vref-line corresponded with the pixels of two adjacent rows. Then, by inserting the reference voltages of the respective display divisions into the reference voltage lines of the pixels of middle rows in the respective display divisions, the reference voltage between the pixels of middle rows of the two adjacent display divisions can appear to have linear change. As an illustration, the OLED display panel 4 of resolution 1080×720 is divided into 4 display divisions. As shown in FIG. 4, all the reference voltage of the pixels of 135th row to 405th row, the reference voltage of the pixels of 405th row to 675th row, the reference voltage of the pixels of 675th row to 945th row appear to have linear changes. The condition of the jump changes among respective display divisions can be prevented.

Figure 6:
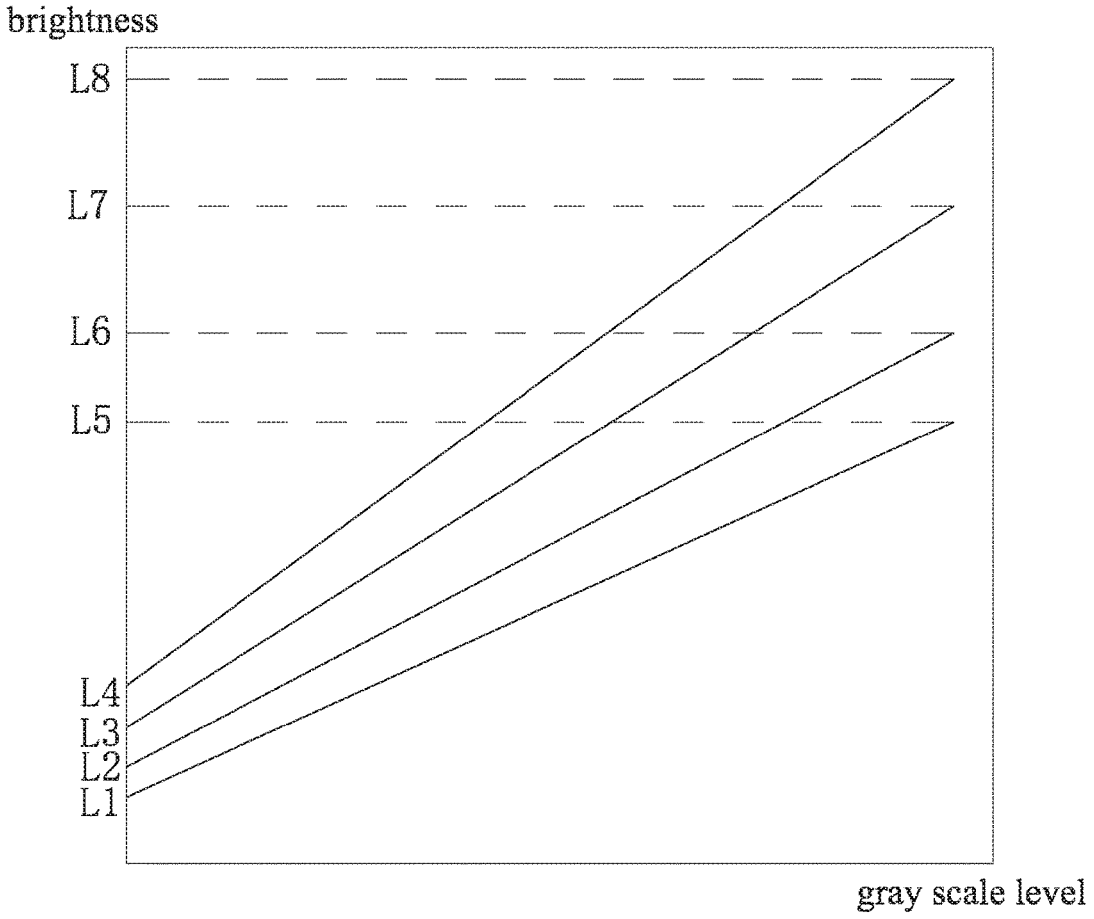
FIG. 6 is a relation curve of gray scale level and brightness after the OLED display panel shown in FIG. 4 is divided into display divisions.

The reference voltages of the respective display divisions in the OLED display panel 4 is different to make the frame contrasts of the respective display divisions be different, too, and the entire contrast of the display frame of the OLED display panel 4 can be raised thereby. Still, as an illustration, the OLED display panel 4 of resolution 1080×720 is divided into 4 display divisions. The reference voltage inserted in the respective display divisions are set to be Vref4>Vref1>Vref2>Vref3. As shown in FIG. 6, the relation curve of gray scale level and brightness is shifted up along with the increase of the reference voltages inserted in the respective display divisions. According to the formula of the contrast, the contrasts respectively corresponded with display division 1 to display division 4 are:

Contrast1=L7/L3

Contrast2=L6/L2

Contrast3=L5/L1

Contrast4=L8/L4

The entire contrast of the display frame of the OLED display panel 4 is:

Contrast=L8/L1

The entire contrast of the display frame of the OLED display panel 4 is higher than the contrast of any display division. In other words, the various reference voltages of the respective display divisions raise the entire contrast of the display frame of the OLED display panel 4.

The image compensation module 5 is employed to receive the image data of one frame provided by the image input module 1, and the brightness calculation module 2 calculates the average pixel brightnesses corresponding to the respective display divisions in the OLED display panel 4, and compensates the image data of one frame according to the average pixel brightnesses of the respective display divisions in the OLED display panel 4, and sends the compensated image data to the sequence controller 6, the source driver 7 and the OLED display panel 4 to ensure the frame display quality.

Figure 7:
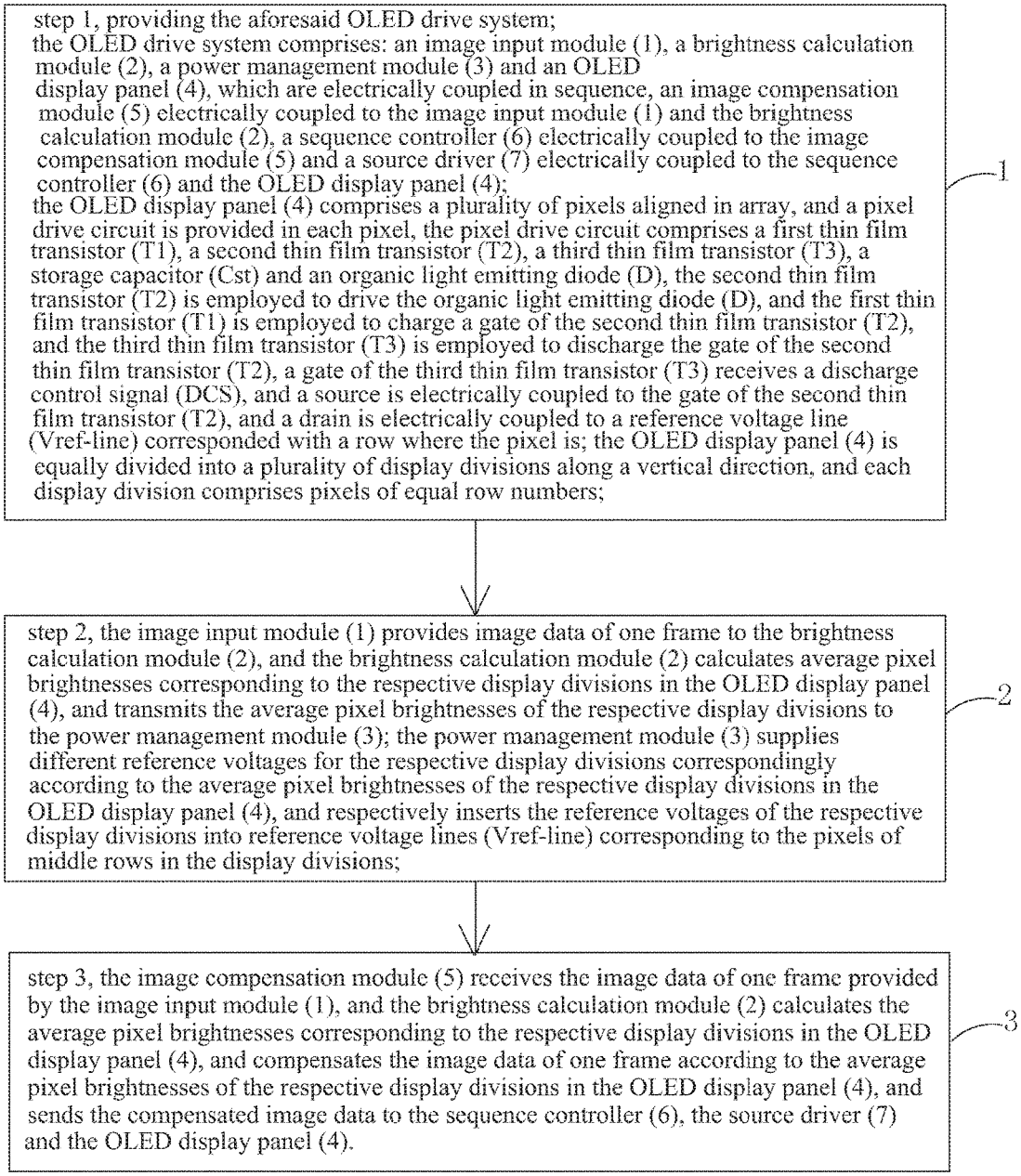
FIG. 7 is a flowchart of an OLED drive method of raising a frame contrast according to the present invention.

On the basis of the OLED drive system of raising a frame contrast according to the present invention, the present invention further provides an OLED drive system of raising a frame contrast, as shown in FIG. 7, comprising steps of:

step 1, providing the aforesaid OLED drive system shown in FIG. 3, FIG. 4 with combination of FIG. 1;

the OLED drive system comprises: an image input module 1, a brightness calculation module 2, a power management module 3 and an OLED display panel 4, which are electrically coupled in sequence, an image compensation module 5 electrically coupled to the image input module 1 and the brightness calculation module 2, a sequence controller 6 electrically coupled to the image compensation module 5 and a source driver 7 electrically coupled to the sequence controller 6 and the OLED display panel 4.

The OLED display panel 4 comprises a plurality of pixels aligned in array, and a pixel drive circuit is provided in each pixel. As shown in FIG. 1, the pixel drive circuit comprises a first thin film transistor T1, a second thin film transistor T2, a third thin film transistor T3, a storage capacitor Cst and an organic light emitting diode D. A gate of the first thin film transistor T1 is electrically coupled to a scan line Gate corresponded with a row where the pixel is, and a source is electrically coupled to a data line Data corresponded with a column where the pixel is, and a drain is electrically coupled to a first node A; a gate of the second thin film transistor T2 is electrically coupled to the first node A, and a drain is electrically coupled to a second node S, and a drain receives a power supply positive voltage OVdd; a gate of the third thin film transistor T3 receives a discharge control signal DCS, and a source is electrically coupled to the gate of the second thin film transistor T2, and a drain is electrically coupled to a reference voltage line Vref-line corresponded with a row where the pixel is; one end of the storage capacitor Cst is electrically coupled to the first node A, and the other end is electrically coupled to the drain of the second thin film transistor T2; an anode of the organic light emitting diode D is electrically coupled to the second node S, and the cathode receives a power source negative voltage OVss. The second thin film transistor T2 is employed to drive the organic light emitting diode D, and the first thin film transistor T1 is employed to charge a gate of the second thin film transistor T2, and the third thin film transistor T3 is employed to discharge the gate of the second thin film transistor T2.

The OLED display panel 4 is equally divided into a plurality of display divisions along a vertical direction, and each display division comprises pixels of equal row numbers. Specifically, the amount of the display divisions of dividing the OLED display panel 4 is not particularly restricted but can be determined according to a resolution of the OLED display panel 4. The larger the resolution of the OLED display panel is, the more is the amount of the display divisions of dividing the OLED display panel.

step 2, the image input module 1 provides image data of one frame to the brightness calculation module 2, and the brightness calculation module 2 calculates average pixel brightnesses corresponding to the respective display divisions in the OLED display panel 4, and transmits the average pixel brightnesses of the respective display divisions to the power management module 3; the power management module 3 supplies different reference voltages for the respective display divisions correspondingly according to the average pixel brightnesses of the respective display divisions in the OLED display panel 4, and respectively inserts the reference voltages of the respective display divisions into reference voltage lines Vref-line corresponding to the pixels of middle rows in the display divisions.

Specifically, in the step 2, the average brightness of some display division in the OLED display panel 4 calculated by the brightness calculation module 2 is larger, and the reference voltage that the power management module 3 correspondingly provides to the display division is higher.

step 3, the image compensation module 5 receives the image data of one frame provided by the image input module 1, and the brightness calculation module 2 calculates the average pixel brightnesses corresponding to the respective display divisions in the OLED display panel 4, and compensates the image data of one frame according to the average pixel brightnesses of the respective display divisions in the OLED display panel 4, and sends the compensated image data to the sequence controller 6, the source driver 7 and the OLED display panel 4.

The step 2, the step 3 are repeatedly implemented. After the drive and display of one frame is completed, the drive and display of the next frame is proceeded.

In the OLED drive method of raising a frame contrast according to the present invention, on one hand, the power management module 3 is employed to supply different reference voltages for the respective display divisions correspondingly according to the average pixel brightnesses of the respective display divisions in the OLED display panel 4, and respectively insert the reference voltages of the respective display divisions into reference voltage lines corresponding to the pixels of middle rows in the display divisions to make the reference voltages of the respective display divisions be different, and then the frame contrasts of the respective display divisions is different, and the entire contrast of the display frame of the OLED display panel 4 can be raised thereby; on the other hand, the image compensation module 5 is employed to compensate the image data of one frame according to the average pixel brightnesses of the respective display divisions in the OLED display panel 4 for ensuring the frame display quality.

Figure 8:
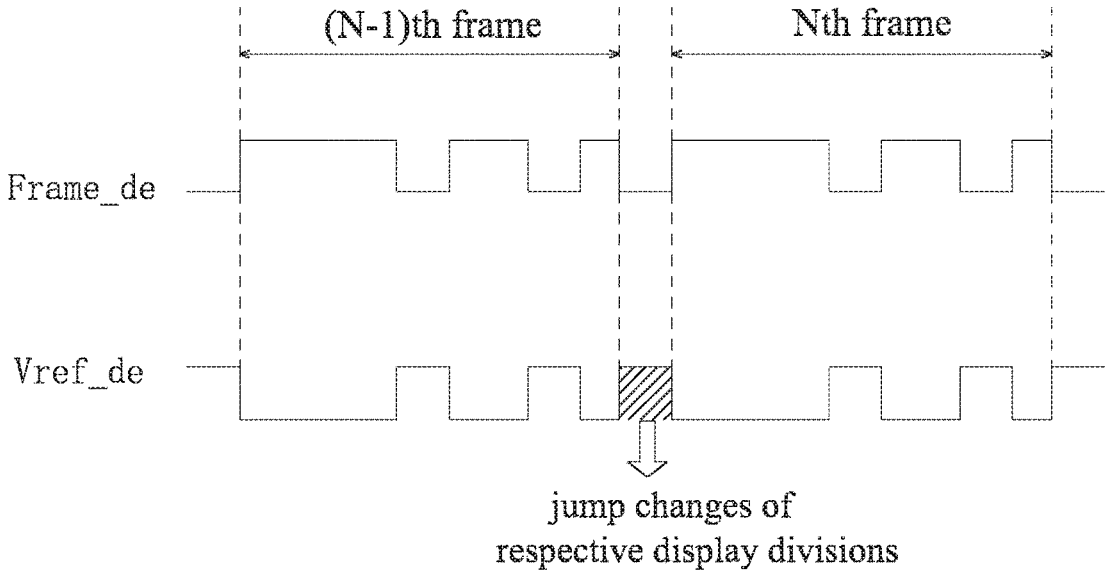
FIG. 8 is a sequence diagram of a line synchronization signal and a reference voltage synchronization signal used in the OLED drive method of raising the frame contrast according to the present invention.

Significantly, the image data of two adjacent different frames are different. Thus, the change procedures of the reference voltages of the respective display divisions exist in the drive progress of the two adjacent frames. As shown in FIG. 8, the jump changes of the reference voltages of the respective display divisions occur after the line synchronization signal Frame_de of the (N−1)th frame (N is a positive integer larger than 1) is pulled down and before the line synchronization signal Frame_de of the Nth frame is raised up; in the same frame, the duration that the line synchronization signal Frame_de corresponded with the latter sub frame is at high voltage level is relatively half of the duration that the line synchronization signal Frame_de corresponded with the former sub frame is at high voltage level. The voltage levels of the reference voltage synchronization signal Vref de and the line synchronization signal Frame_de are opposite.

In conclusion, in the OLED drive system raising the frame contrast and the drive method according to the present invention, the OLED display panel is equally divided into a plurality of display divisions along a vertical direction. The brightness calculation module is employed to calculate average pixel brightnesses corresponding to the respective display divisions in the OLED display panel. On one hand, the power management module is employed to supply different reference voltages for the respective display divisions correspondingly according to the average pixel brightnesses of the respective display divisions in the OLED display panel, and respectively insert the reference voltages of the respective display divisions into reference voltage lines corresponding to the pixels of middle rows in the display divisions to make the reference voltages of the respective display divisions be different for raising the frame contrast, on the other hand, the image compensation module is employed to compensate the image data of one frame according to the average pixel brightnesses of the respective display divisions in the OLED display panel for ensuring the frame display quality.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. An organic light emitting display (OLED) drive method of raising a frame contrast, comprising steps of:

step 1, providing an OLED drive system, which comprises an OLED display panel;

wherein the OLED display panel comprises a plurality of pixels aligned in an array including multiple rows and multiple columns, and a pixel drive circuit is provided in each pixel, wherein the pixel drive circuit comprises a first thin film transistor, a second thin film transistor, a third thin film transistor, a storage capacitor and an organic light emitting diode, and the second thin film transistor is employed to drive the organic light emitting diode, and the first thin film transistor is employed to charge a gate of the second thin film transistor, and the third thin film transistor is employed to discharge the gate of the second thin film transistor; the third thin film transistor comprises a gate that receives a discharge control signal, a source that is electrically coupled to the gate of the second thin film transistor, and a drain that is electrically coupled to a reference voltage line corresponding to one of the rows where the pixel is located; and the OLED display panel is equally divided into a plurality of display divisions in a vertical direction, wherein each of the display divisions comprises a number rows of the multiple rows, the number of rows of the display divisions being identical, one of the number of rows of each of the display divisions comprising a middle one of the number of rows; and step 2, supplying image data of one frame to the OLED display panel and, in response to the image data, calculating an average pixel brightness level for each of the display divisions of the OLED display panel, and determining reference voltages for the display divisions respectively according to the average pixel brightness levels of the respective display divisions of the OLED display panel, such that the reference voltages of the respective display divisions are respectively applied to reference voltage lines corresponding to the middle rows of the display divisions.

2. The OLED drive method of raising the frame contrast according to claim 1, further comprising step 3, compensating the image data of the one frame according to the average pixel brightness levels of the respective display divisions of the OLED display panel to provide compensated image data that are subsequently fed to the OLED display panel.

3. The OLED drive method of raising the frame contrast according to claim 1, wherein the reference voltage of each of the display divisions are determined such that the higher the average pixel brightness levels are, the higher the reference voltages are.

4. The OLED drive method of raising the frame contrast according to claim 1, wherein the first thin film transistor has a gate that is electrically coupled to a scan line corresponding to one of the rows where the pixel is located, a source that is electrically coupled to a data line corresponding to one of the columns where the pixel is located, and a drain that is electrically coupled to a first node; the gate of the second thin film transistor is electrically coupled to the first node, and the second thin film transistor comprises a source that is electrically coupled to a second node and a drain that receives a power supply positive voltage; the storage capacitor comprises a first end that is electrically coupled to the first node and a second end that is electrically coupled to the drain of the second thin film transistor; and an anode of the organic light emitting diode is electrically coupled to the second node, and a cathode of the organic light emitting diode receives a power source negative voltage.

* * * * *